US007815173B2

(12) United States Patent
Lin

(10) Patent No.: US 7,815,173 B2
(45) Date of Patent: Oct. 19, 2010

(54) COOLER

(76) Inventor: Yi-Hsiung Lin, P.O. Box 90, Tainan City 70499 (TW)

( * ) Notice: Subject to any disclaimer, the term of this patent is extended or adjusted under 35 U.S.C. 154(b) by 315 days.

(21) Appl. No.: 12/108,534

(22) Filed: Apr. 24, 2008

(65) Prior Publication Data

US 2009/0266517 A1 Oct. 29, 2009

(51) Int. Cl.
*B01F 3/04* (2006.01)

(52) U.S. Cl. ..... 261/151; 62/310; 62/314; 165/104.32; 165/104.34; 261/152; 261/155; 261/DIG. 11

(58) Field of Classification Search ..... 261/151–153, 261/155, 156, DIG. 11; 62/310, 311, 314; 165/104.19, 104.32, 104.34
See application file for complete search history.

(56) References Cited

U.S. PATENT DOCUMENTS

| | | | | |
|---|---|---|---|---|
| 2,247,514 | A * | 7/1941 | Mart | 261/147 |
| 2,507,604 | A * | 5/1950 | Lawson | 165/96 |
| 3,052,105 | A * | 9/1962 | Bowman et al. | 62/305 |
| 3,195,870 | A * | 7/1965 | Gruber et al. | 261/25 |
| 3,533,607 | A * | 10/1970 | Powers | 261/25 |
| 3,865,911 | A * | 2/1975 | Lefevre | 261/140.1 |
| 4,032,604 | A * | 6/1977 | Parkinson et al. | 261/111 |
| 4,543,218 | A * | 9/1985 | Bardo et al. | 261/24 |
| 4,781,869 | A * | 11/1988 | Wiltz | 269/109 |
| 5,390,502 | A * | 2/1995 | Storbeck et al. | 62/91 |
| 6,237,900 | B1 * | 5/2001 | Drew et al. | 261/111 |
| 7,364,141 | B2 * | 4/2008 | Brenneke et al. | 261/146 |
| 2003/0145619 | A1 * | 8/2003 | Word | 62/310 |
| 2009/0071182 | A1 * | 3/2009 | Lin | 62/303 |
| 2009/0188651 | A1 * | 7/2009 | Lin | 165/104.28 |
| 2009/0266517 | A1 * | 10/2009 | Lin | 165/104.19 |

FOREIGN PATENT DOCUMENTS

| | | | | |
|---|---|---|---|---|
| JP | 60-82781 | A * | 5/1985 | 261/DIG. 11 |

* cited by examiner

*Primary Examiner*—Richard L Chiesa

(57) ABSTRACT

A cooler includes a body, a water tank installed in the body for storing cooling water, a pump fixed in the water tank, a water pipe connected to the pump and extending upward, a spray pipe connected to the water pipe, at least one gas cooling device located above the spray pipe, at least one fan fixed on top of the body, at least one wind hole formed in a side of the body, at least one cooling pipe uprightly installed in the body and having an upper portion passing through heat-dispersing chips of the gas cooling device and a lower portion passing through heat-dispersing chips of the water cooling device, and at least one water-heat exchanger below the spray pipe and having a heat-dispersing element. The cooler has two stages of cooling by air and water, having a high effect of swift cooling high temperature to low temperature.

3 Claims, 2 Drawing Sheets

COOLER

BACKGROUND OF THE INVENTION

1. Field of the Invention

This invention relates to a cooler, particularly to one utilizing one stage of air cooling and one stage of water cooling, so that liquid or gas stored in a heat exchanger to be cooled can flow in a hot condition and move out in a cooled condition, with swift effectiveness.

2. Description of the Prior Art

Generally, a cooler for cooling down hot liquid or gas is provided with a cooling pipe inside, which has a water inlet at one end and a water outlet in the other end. The cooler has an inlet for hot liquid and an outlet for cooled liquid. When hot liquid is to be cooled, it is fed into the cooler through the inlet, gradually cooled by the cooling pipe in the cooler, and the cooled liquid flows out of the outlet for reuse. In the meanwhile, cooling water becomes hot after heat exchange and flows out of the water outlet. Nevertheless, the conventional cooler carries out cooling only by means of water, requiring a rather large water tank and comparatively long hours for cooling in order to bring down high temperature of liquid or gas to a low temperature for reuse. Moreover, warmed-up cooling water is exhausted out, but not utilized for other purpose, wasting valuable resources.

SUMMARY OF THE INVENTION

This invention has been devised to offer a cooler with two cooling stages by air and water so as to carrying out swift cooling.

The features of the invention are a body, a water tank, a pump, at least one water pipe, at least one gas cooling device, at least one fan, at least one wind hole, at least one cooling pipe, at least one water-heat exchanger, and at least one water cooling device.

The water tank is installed in the body, and the pump is fixed in the water tank, with the water pipe connected to the pump and extending up to be connected with the lateral spray pipe. The gas cooling device is located a little above the spray pipe, having plural heat-dispersing chips. The wind fan is fixed outside on top of the body, with the wind inlet formed in the side of the body. The cooling pipe has an upper portion bent laterally to pass through the heat-dispersing chips of the gas cooling device. Then the cooling pipe has two ends respectively formed with an upper inlet-exit and a lower inlet-exit, with the lower portion with the lower inlet-exit located on the water tank. The water-heat exchanger is located below the spray pipe, having at least one heat-dispersing element. The water cooling device is located below the water-heat exchanger, having plural heat-dispersing chips through which the lower portion of the cooling pipe passes through.

BRIEF DESCRIPTION OF DRAWINGS

This invention will be better understood by referring to the accompanying drawings, wherein.

DETAILED DESCRIPTION OF THE PREFERRED EMBODIMENT

Figure 1:
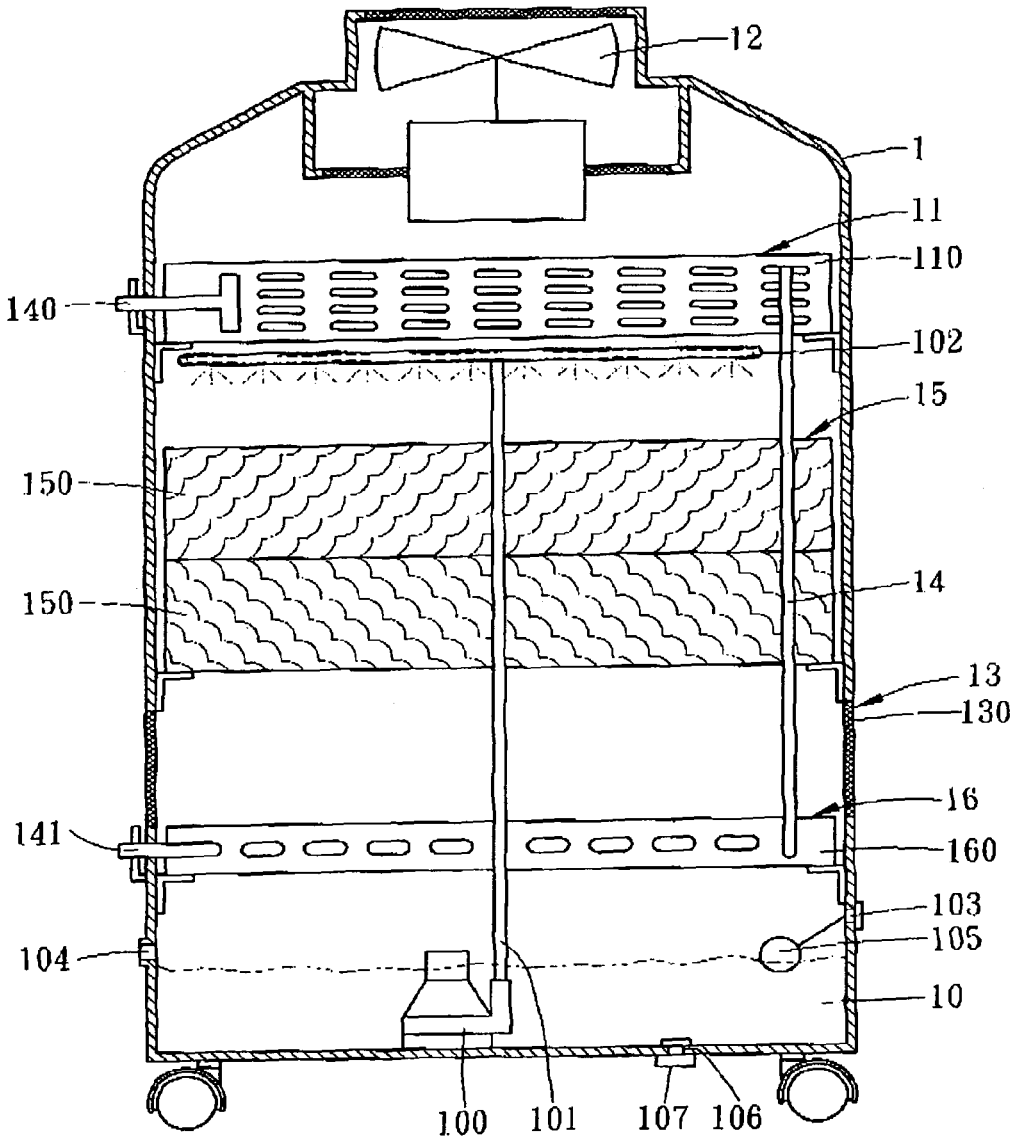
FIG. 1 is a cross-sectional view of a cooler in the present invention.

A preferred embodiment of a cooler in the present invention, as shown in FIG. 1, includes a body 1, a water tank 10, at least one gas cooling device 11, at least one fan 12, at least one wind inlet 13, a cooling pipe 14, at least one water-heat exchanger 15, and at least one water heat-dispersing device 16.

The water tank 10 is installed in the body 1, provided with a pump 100 on the bottom of the body 1, a water pipe 101 connected to the pump 100 and extending up upright, a horizontal spray pipe 102 connected to the upper end of the water pipe 101 at its center point, a filling hole 103 and an overflow hole 104 formed respectively in opposite side walls of the water tank 10, a float 105 floating on the water in the water tank 10 for controlling the level of the water therein, and an exhaust hole 106 formed in its bottom wall with a stopper 107 blocking up the exhaust hole 106.

The gas cooling device 11 is installed a little above the spraying pipe 102, provided with plural heat-dispersing chips 110 properly arranged.

The fan 12 is fixed outside on top of the body 1.

The wind inlet 13 is formed in a side of the body 1, having at least one air filter net 130 closed on the wind inlet 13 for filtering air flowing in the cooler.

The cooling pipe 14 is installed upright in the body 1, provided with an upper laterally bent portion extending through the heat-dispersing chips 110 of the gas cooling device 11 and an upper inlet-exit 140 formed at its upper end and a lower laterally bent portion extending through the water cooling device 16 on the water tank 10 and a lower inlet-exit 141 formed at its lower end.

The water-heat exchanger 15 is installed below the gas cooling device 11 and the spray pipe 102, having plural heat-dispersing chips 150 properly arranged.

The water cooling device 16 is installed below the water tank 10, provided with plural heat-dispersing chips 160 properly arranged to be passed though by the lower lateral portion with the lower inlet-exit 141.

Figure 2:
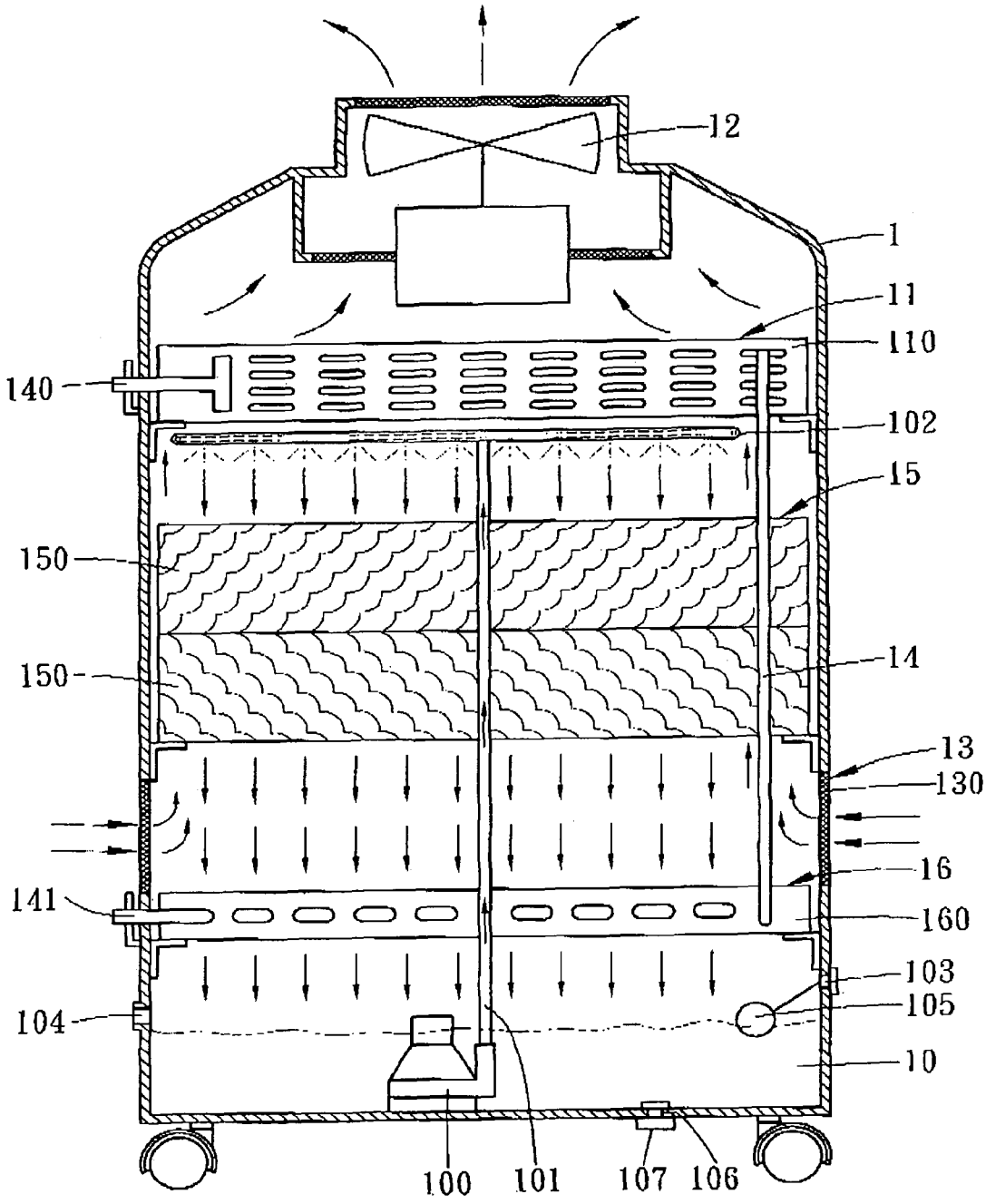
FIG. 2 is a cross-sectional view of the cooler under a using condition in the present invention.

In using the cooler, as shown in FIG. 2, the operation of gas cooling is effected by starting the fan 12 to suck air into the body 1 through the wind inlet 13, letting the substance to be cooled (such as gas or liquid) in the cooling pipe 14 cooled by the gas cooling device 11 and its heat-dispersing chips 110.

As for operation of liquid (such as water), cooling water is pumped by the pump 100 to flow through the water pipe 101 upward to the spray pipe 102, which then sprays the cooling water towards the water-heat exchanger 15, with the cooling water dropping down along the heat-dispersing chips 150 to the water cooling device 16 and its heat-dispersing chips 160, so that the substance (such as gas or liquid) to be cooled in the cooling pipe 14 may be cooled down. In this way, the substance to be cooled can swiftly be cooled down by the two stages of cooling to a normal (or room) temperature for reuse.

The cooler in the present invention has the following advantages, as can be understood from the foresaid description.

1. It has a first stage of cooling by air blown by the fan for cooling the gas cooling device and a second stage of cooling by water pumped by the pump and the water-heat exchanger, so gas or liquid to be cooled can be swiftly cooled down during flowing in the cooling pipe in the cooler for reuse.

2. The water-heat exchanger is applicable to hot water-lacking regions and hot substances to be cooled.

3. It can highly effectively be used for cooling and air conditioning, and enhancing cooling capacity.

4. It is quite different from conventional water cooling towers, with the substance to be cooled flowing around in a pipe without contacting with outer air, and liquid and gas to be cooled is not to be polluted by outer air, not growing fur or miscellaneous matters, maintaining a long period of best cooling effect.

5. It has a simple structure, saving electricity more than any other cooling systems, obtaining high effect for accurate cooling.

While the preferred embodiment of the invention has been described above, it will be recognized and understood that various modifications may be made therein and the appended claims are intended to cover all such modifications that may fall within the spirit and scope of the invention.

What is claimed is:

1. A cooler comprising:

a body;

a water tank installed on a bottom of said body for storing cooling water, at least one pump provided in said water tank, at least one water pipe connected to said pump and extending upward, a spray pipe horizontally installed and having its center point connected to an upper end of said water pipe;

at least one gas cooling device installed a little above said spray pipe and having plural heat-dispersing chips properly arranged;

at least one fan fixed outside on top of said body;

at least one wind inlet formed in opposite sides of said body;

at least one cooling pipe installed in said body and having an upper portion laterally extending through said heat-dispersing chips of said gas cooling device, said cooling pipe having an upper inlet-exit formed at an upper end and a lower inlet-exit formed at a lower end, a lower lateral portion with said lower inlet-exit located on said water tank;

at least one water-heat exchanger installed below said spray pipe and having at least one heat-dispersing element; and, at least one water cooling device installed below said water-heat exchanger and on said water tank, said water cooling device provided with plural heat-dispersing chips that arc penetrated through by said lower lateral portion of said cooling pipe.

2. The cooler as claimed in claim 1, wherein said water tank is formed with a filling hole and an overflow hole respectively in its opposite sides, and a float is provided to float on water stored in said water tank for controlling a level of the water therein, with an exhaust hole formed in a bottom of said water tank and a stopper blocking up said exhaust hole.

3. The cooler as claimed in claim 1, wherein said wind hole is closed up with a filter net.

* * * * *